United States Patent [19]

Jankowski et al.

[11] Patent Number: 4,744,599

[45] Date of Patent: May 17, 1988

[54] TWO-POSITION PLAYSEAT COUPLING

[75] Inventors: Mark D. Jankowski, Akron; Robert L. Quinlan, Jr., Stow, both of Ohio

[73] Assignee: Gerber Products Company, Fremont, Mich.

[21] Appl. No.: 928,446

[22] Filed: Nov. 7, 1986

[51] Int. Cl.[4] ..... A47D 1/10

[52] U.S. Cl. ..... 297/250; 297/328; 297/130; 297/273

[58] Field of Search ..... 297/250; 297/130, 281, 297/327, 328, 329, 273

[56] References Cited

U.S. PATENT DOCUMENTS

| | | | |
|---|---|---|---|
| 1,176,811 | 3/1916 | Bobbitt . | |
| 1,403,552 | 1/1922 | Holmes . | |
| 2,784,765 | 3/1957 | Morrissette . | |
| 3,031,687 | 5/1962 | McNeil Stevens et al. | 5/109 |
| 3,146,985 | 9/1964 | Grudoski | 248/370 |
| 3,261,032 | 7/1966 | Reardon | 5/108 |
| 3,371,358 | 3/1968 | Shackel | 5/108 |
| 3,842,450 | 10/1974 | Pad | 5/109 |
| 3,883,136 | 5/1975 | Ho Kim | 272/86 |
| 4,415,200 | 11/1983 | Bourne | 297/174 |
| 4,634,177 | 1/1987 | Meeker | 297/250 |

*Primary Examiner*—Francis K. Zugel
*Attorney, Agent, or Firm*—Townsend and Townsend

[57] ABSTRACT

A latch mechanism for securing a detachable seat to a frame such as that used on a child's swing is comprised of a hook depending from a hub on each side of the seat, and a U-shaped collar to receive the hub with a flange to engage the hook. As the hook slides along the flange, the angle of the seat with respect to the frame is varied, and a retractable bolt secures the hook at either of two positions along the flange.

10 Claims, 4 Drawing Sheets

TWO-POSITION PLAYSEAT COUPLING

BACKGROUND AND SUMMARY OF THE INVENTION

This invention relates to children's furniture, and particularly to a latching mechanism such as that used to join a portable seat to a support frame. The support frame of primary interest herein is a child's swing which the child may be placed in for its amusement, for rocking it to sleep or when not swinging for such functions as feeding the child. Detachable seats are used with such frames so that the seat may be removed with the child still in it and used for hand carrying, or latching into other frames such as a brace mounted to a car seat.

In accordance with the present invention, the seat is provided with added versatility by a latch mechanism which permits locking the seat in the frame in either of two positions, one being an upright position as used for the amusement or the feeding of the child. and the other a reclining position as used for rocking an infant to sleep. Embodiments of the invention contain a latch positioned on each side of the seat, with parts on the seat shell mating with parts on the swinging arms of the swing frame. Hand-operated levers on the swing arms operate to engage or release the latch. The contact surfaces between the seat shell and the swing arms are preferably curved in a circular arc to permit rotation of the seat between the two positions.

Other features and embodiments of the invention will be apparent from the following description.

Figure 1:
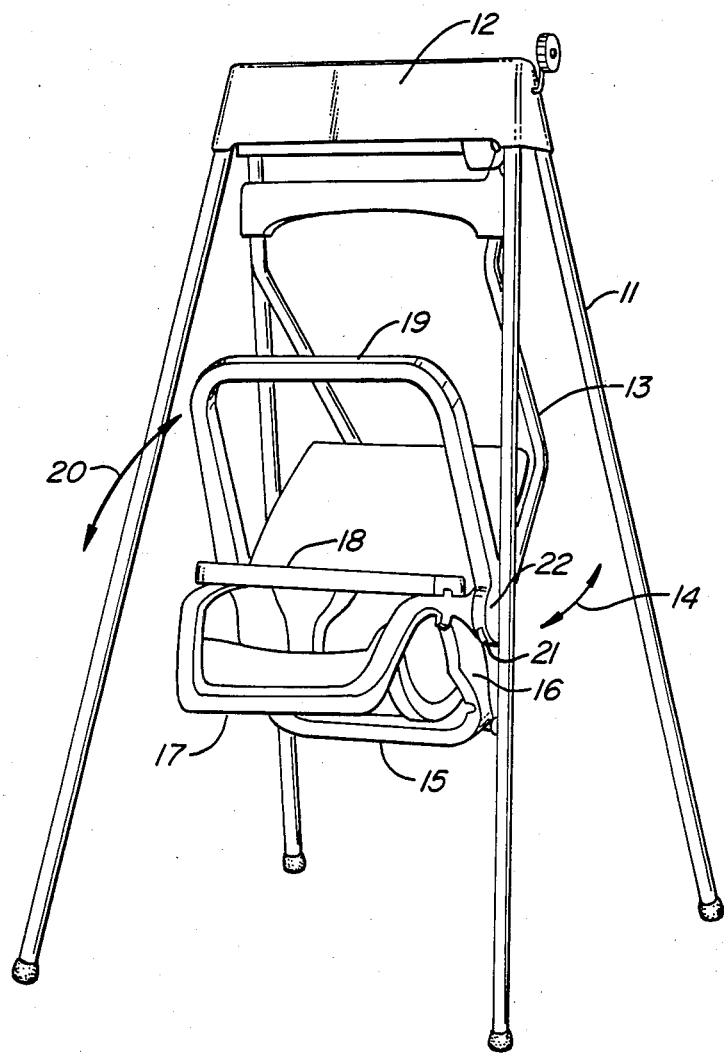
FIG. 1 is a perspective view of a swinging playseat incorporating a latch mechanism according to one embodiment of the present invention.

FIGS. *3a* and *3b* are enlarged detail views of a portion of the swinging support frame of the embodiment shown in FIG. 1. FIG. *3a* is a perspective view and FIG. *3b* is a side elevation of a portion of FIG. *3a*.

Figure 4:
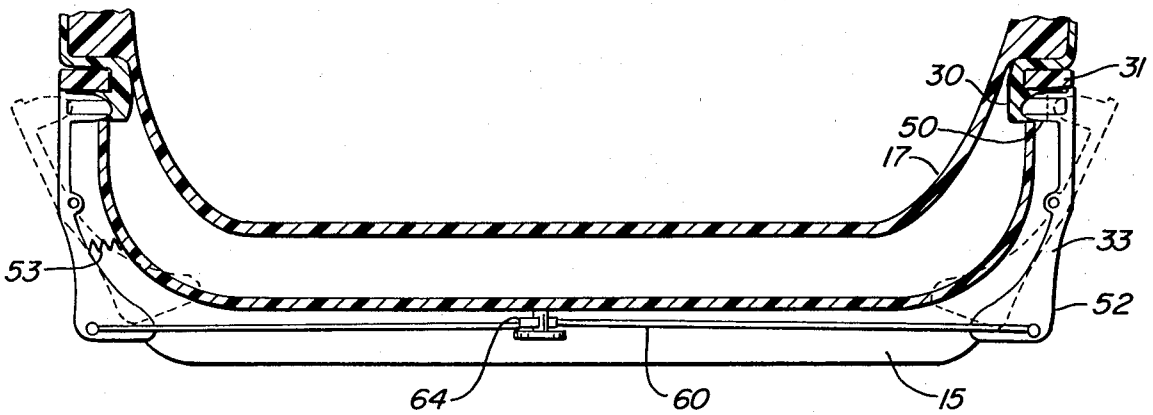

FIG. 4 is a front elevation and cutaway of the seat and swinging frame of the embodiment of FIG. 1.

Figure 5:
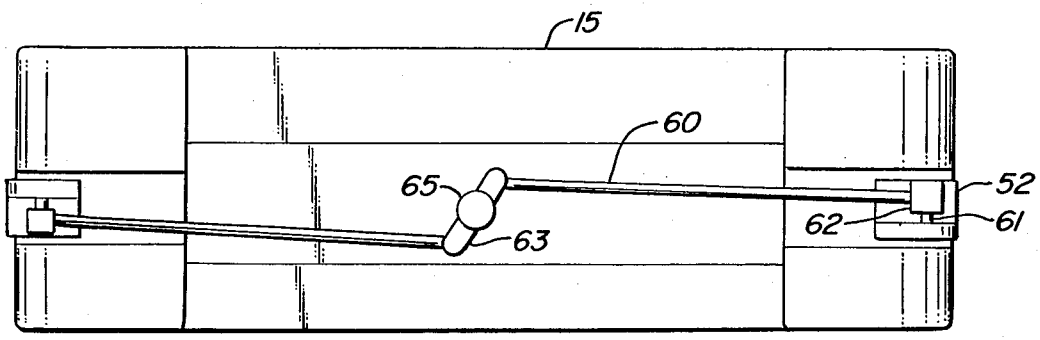

FIG. 5 is a view from underneath of the swinging frame shown in FIG. 4 including the latch mechanism.

DETAILED DESCRIPTION OF THE INVENTION AND PREFERRED EMBODIMENTS

FIG. 1 depicts an illustrative playseat mounted on a swinging frame. The frame is comprised of stationary legs 11 forming an A-frame structure with a horizontal bar 12 along the top. Suspended from the bar are swing arms 13 in a pivoting arrangement permitting a swinging motion back and forth along the direction of the arrow 14. The swing arms are joined at the bottom by a crossbeam 15 with a yoke or collar 16 extending upward from each end thereof (only one is shown). The seat shell 17 has contoured surfaces on each side which mate with these collars, the mating portions containing the latch mechanism, shown in detail in subsequent drawings.

In the embodiment shown, the seat further contains a removable tray 18 and a handle 19 by which the seat may be lifted out of the collars 16 and carried by hand. The handle is rotatable in the direction shown by the arrow 20 so that it may be moved out of the way when not in use, or rotated to extend downward at an angle from the rear to be used as a prop to support the seat in an upright position when the seat is placed alone on the floor or a table. A lock-and-release button 21 at pivot end 22 of the handle can be used to lock it into place at any of several preselected positions, and to release the handle when pushed in to permit rotation.

Figure 2:
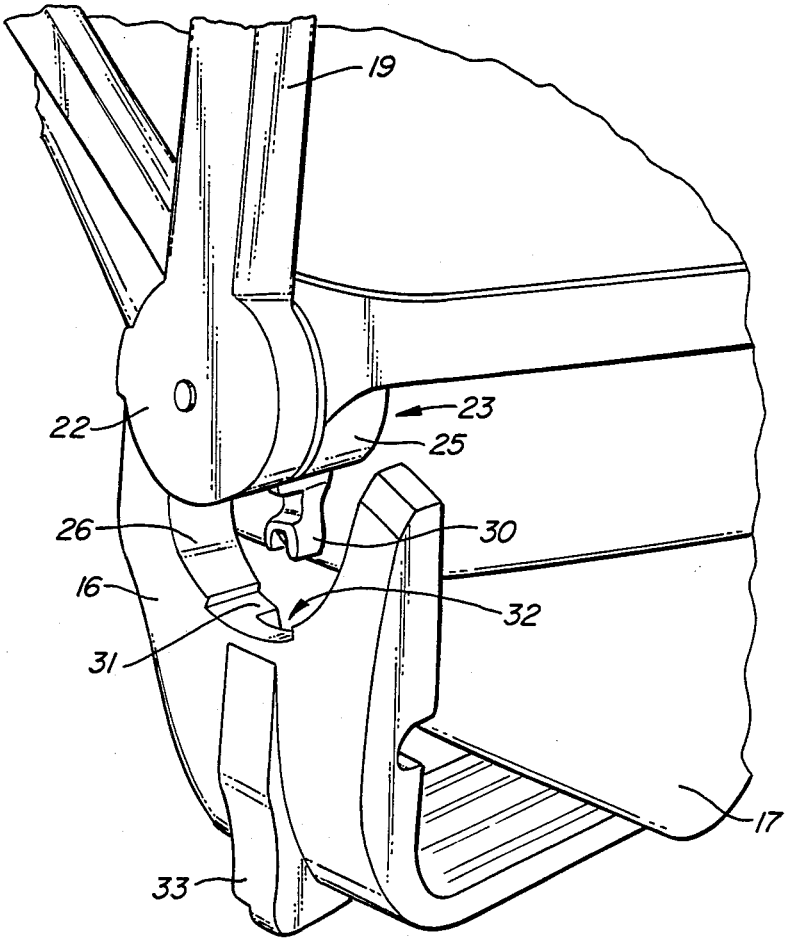
FIG. 2 an enlarged view in perspective of the mating parts of the seat shell and frame of the latch mechanism shown in FIG. 1.

FIG. 2 is a close-up view of parts of the apparatus of FIG. 1 including the mating portions at one side of the seat shell and swinging frame and surrounding regions. The seat shell 17 is shown slightly separated from the collar 16 to render the operative elements of these parts visible. The swing arm itself has been eliminated for the same reason.

The portion of the seat 17 which contacts the yoke 16 is a hub 23 to which the pivot end 22 of the handle 19 is mounted. The outer edge 25 of the hub is curved in the shape of a circular arc, as is the internal surface 26 of the collar 16. The hub 23 thus nests inside the collar 16 with these curved surfaces mating, permitting a limited degree of rotation of the hub inside the seat shell.

Extending downward from the hub 23 is a hook 30. When the curved surfaces of the hub and yoke are joined, the hook 30 extends downward beneath the rim of the hub, hooking underneath a flange 31 along the rim. A gap 32 in the flange allows passage of the hook 30 during assembly and disassembly of the parts. A lever 33 on the exterior of the yoke 16 controls a lock mechanism (seen in detail in the subsequent drawings) for retaining the hook 30 under the flange 31, obstructing the passage of the hook through the gap 32.

FIGS. *3a* and *3b* show the opposite side of the yoke 16 with the lever 33 removed. The inner surface of the yoke includes a recess 36 for the swing arm 13 of FIG. 1. The gap 32 is visible in full in these drawings, dividing the flange into two segments 37, 38, each of which is of sufficient length to accommodate the full width of the hook 30 (FIG. 2). The gap 32 is also of sufficient width to permit passage of the hook 30.

Once the hook is inserted through the gap, it may be slid either forward or back to clear the gap and engage either of the two flange segments 37, 38. respectively. The gap 32 has side walls 39, 40 sloping inward to facilitate insertion of the hook. An orifice 41 in the collar permits the insertion of a bolt (not shown) to prevent the sliding of the hook along the flanges 37, 38. This locks the hook into position under one or the other of the flange segments. The bolt is part of the lever shown in FIG. 2, and is thus retractable by pivoting of the lever. Fixed stops 39, 40 at the outer ends of each of the two flange segments prevent further shifting of the hook once the bolt is engaged.

Once the hook 30 is inserted through the gap 32, the seat shell hub may be rotated in the yoke to place the hook under either of the two flange segments 37, 38. Each flange segment sets the angle or position of the seat with respect to the frame. This rotation is independent of the rotation of the handle 19 shown in FIGS. 1 and 2. The arc-shaped edge of the pivot end of the handle 22 is in fact retained forward of the yoke 16 so that the handle may still be rotated freely while the seat shell is securely locked into the yoke.

Figure 3A:
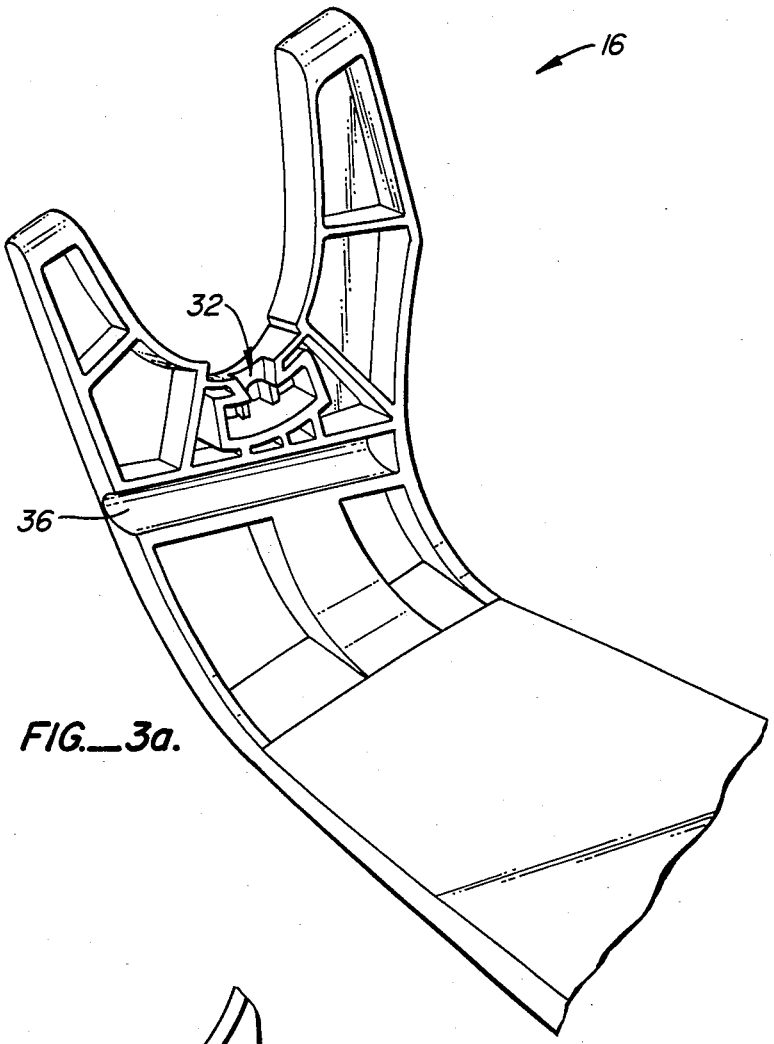
Figure 3B:
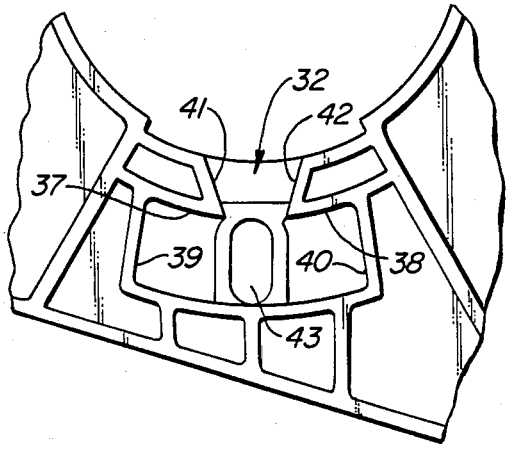

The sectional view of FIG. 4 shows both sides of the crossbeam 15 and the seat shell 17 with a latch mechanism in accordance with the present invention on each side. The hooks 30 on each side are shown in engagement with the flange 31, and the levers 33 are shown in profile. The bolt portion 50 of the lever (referred to but not shown in connection with FIG. 3) is shown obstructing the hook 30 from lateral sliding along the flange 31 (i.e. perpendicular to the plane of the drawing). The lever 33 is pivotable around a pivot pin 51, and may be operated manually by pressing against a lower exterior surface 52. The lever is shown in solid line with the bolt portion 50 inserted through the orifice 41 (FIG. 3) to obstruct the hook 30, and in dashed lines pivoted outward with the bolt portion clearing the way for free passage of the hook 30. A spring 53 biases the positions of both levers toward positions in which the bolts 50 are inserted to prevent movement of the hooks 30.

Synchronous motion of the two levers is achieved by a linkage passing underneath the crossbeam 15 and joining their lower ends. A detailed view of the linkage is seen in FIG. 5. A rod 60 is pivotally mounted to the bottom end of each lever at a post 61 through a pivot joint 62. The two rods are in turn connected to a pivot link 63 through pivot joints 64 (FIG. 4). The pivot link 63 is mounted to the underside of the crossbeam 15 through a further pivot joint 65. Thus, inward rotation of the bottom end 52 of either lever causes rotation of the pivot link 63 in the counterclockwise direction which in turn pulls the opposing lever in, resulting in simultaneous release of the latch mechanisms on both sides of the seat shell.

The foregoing description is offered primarily for purposes of illustration. It will be readily apparent to those skilled in the art that numerous modifications and variations of the various elements of construction and operation described above may be introduced without departing from the spirit and scope of the invention.

What is claimed is:

1. A two-position latch for joining a seat to a frame, comprising a hub on the side of said seat with a hook projecting therefrom;

a U-shaped collar on said frame to receive said hub:

a flange along said U-shaped collar having a gap therein to receive said hook, said gap dividing said flange into first and second flange segments to engage said hook; and a retractable stop in said frame engageable with said collar to prevent travel of said hook between said first and second flange segments.

2. A two-position latch in accordance with claim 1 in which said hub and said U-shaped collar have arc-shaped contacting surfaces whereby said hook is slidable along said flange by rotation of said hub.

3. A two-position latch in accordance with claim 1 in which said retractable stop is pivotally mounted to said frame.

4. A two-position latch in accordance with claim 1 in which said retractable stop is spring-biased into engagement with said collar.

5. A two-position latch in accordance with claim 1 further comprising first and second fixed stops on said first and second flange segments, respectively, limiting the travel of said hook along said flange segments.

6. A two-position latch in accordance with claim 1 in which said retractable stop has a sloped surface facing said gap whereby passage of said hook through said gap causes retraction of said retractable stop.

7. A two-position latch in accordance with claim 1, further comprising:

a pair of said hubs, one on either side of said seat, each having a hook projecting therefrom, a pair of said U-shaped collars to receive said hubs, each having first and second flange segments separated by a gap:

a pair of said retractable stops extending from first and second levers, respectively pivotally mounted to said frame; and means for joining said first and second levers to effect synchronous pivoting thereof and thereby synchronous retraction of said retractable stops.

8. A two-position latch in accordance with claim 7 in which said joining means is comprised of first and second rods pivotally mounted to said first and second levers respectively and joined by a pivot link pivotally mounted to said frame.

9. A two-position latch in accordance with claim 7 in which said first and second levers are spring-biased toward engagement of said retractable stops with said collars.

10. A two position latch for joining a seat to a frame comprising:

a hub on the side of said seat having an arc-shaped edge with a hook projecting therefrom;

a collar on said frame having a rim contoured to mate with said arc-shaped edge:

a flange along said rim having a gap to receive said hook, said gap dividing said flange into first and second flange segments to engage said hook and to permit travel of said hook therealong upon rotation of said hub in said collar, said flange segments extending from said gap to terminate at first and second stops, respectively; and a bolt extending from a lever pivotally mounted to said frame to block travel of said hook thereby retaining said hook against one of said first and second stops.

* * * * *